US006941588B1

(12) United States Patent
Oprandi

(10) Patent No.: US 6,941,588 B1
(45) Date of Patent: Sep. 13, 2005

(54) AUTOMATIC TOILET COVER CLOSURE DEVICE

(76) Inventor: Arthur V. Oprandi, 385 N. Point Rd. #1001, Osprey, FL (US) 34229

( * ) Notice: Subject to any disclaimer, the term of this patent is extended or adjusted under 35 U.S.C. 154(b) by 0 days.

(21) Appl. No.: 11/049,469

(22) Filed: Feb. 2, 2005

(51) Int. Cl.[7] ..... A47K 13/10
(52) U.S. Cl. ..... 4/246.1
(58) Field of Search ..... 4/246.1–246.5, 4/248, 250, 253, 241

(56) References Cited

U.S. PATENT DOCUMENTS

| | | | | |
|---|---|---|---|---|
| 4,491,989 | A | 1/1985 | McGrail | |
| 5,289,593 | A | 3/1994 | Lawrence | |
| 5,319,810 | A | 6/1994 | Metzger | |
| 5,430,897 | A | 7/1995 | Lavender | |
| 5,592,700 | A | 1/1997 | Genesse | |
| 5,689,838 | A | 11/1997 | MacKenzie | |
| 5,754,985 | A | 5/1998 | Dias | |
| 6,185,754 | B1 | 2/2001 | Dysle | |
| 6,526,600 | B1 | 3/2003 | Hernandez | |
| 6,883,186 | B1 * | 4/2005 | Hernandez | 4/246.1 |

* cited by examiner

*Primary Examiner*—Tuan Nguyen
(74) *Attorney, Agent, or Firm*—Charles J. Prescott

(57) ABSTRACT

An apparatus for automatically lowering a raised toilet seat pivotally attached to a back of a bowl of a toilet. The apparatus includes a preferably U-shaped support member to be supported over a front wall of the water tank. An elongated arm is pivotally supported at an upper end thereof to an upper end of the support member. A float is to be positioned in the water tank and is moved vertically on the support member when the tank is flushed. A movable member is positioned in contact between the support member and the arm and is attached to a flexible line which extends along the support member to the float. The movable member is arranged to pivotally move the arm outwardly when the toilet is flushed, pushing the cover and toilet seat together away from the tank a distance sufficient for the cover and toilet seat to then pivotally fall into a closed position atop the bowl.

9 Claims, 7 Drawing Sheets

AUTOMATIC TOILET COVER CLOSURE DEVICE

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to flush toilet mechanisms, and more particularly to an apparatus which automatically closes the toilet cover after each flush.

2. Description of Related Art

The desirability of maintaining the seat and cover of a toilet in a closed position after each flush has been well established. This closed configuration of the cover not only presents a more tidy appearance, but also insures that female toilet users are not inadvertently exposed to the hazards of sitting on an open toilet.

A great number of prior art devices have been shown in prior art to disclose such devices and apparatus for this purpose. U.S. Pat. No. 4,491,989 to McGrail discloses a device for automatically lowering a toilet seat and/or lid, when the flushing handle of a toilet is actuated. Lawrence, in U.S. Pat. No. 5,289,593, teaches an automatic closure for toilet seats employing weight-driven cords or cables for lowering the toilet seat upon flushing the toilet.

A toilet flushing arrangement designed to keep the seat and cover in the closed position is taught by Metzger in U.S. Pat. No. 5,319,810. Lavender, in U.S. Pat. No. 5,430,897, teaches a toilet seat lowering device comprising a trip wire attached to the toilet flush crank arm.

U.S. Pat. No. 5,592,700 to Genesse teaches an automatic toilet lid closer with an arm pivotally attached to a mounting pedestal attached to a side of a toilet water tank. MacKenzie teaches an apparatus for lowering toilet seat and toilet lids automatically mounted on the water tank of a conventional toilet in U.S. Pat. No. 5,689,838.

An apparatus for raising and lowering a toilet lid utilizing weights, one of which is located in the toilet tank is taught by Dias in U.S. Pat. No. 5,745,985. Dysle teaches an automatic seat lowering system in U.S. Pat. No. 6,185,754 wherein the mounting assembly is in communication with the water line of the toilet for effecting lowering of the seat upon flushing. Hernandez, in U.S. Pat. No. 6,526,600 teaches a device for automatically manipulating a toilet lid wherein an actuator associated therewith pivots said structure in response to lowering of the water level in the toilet tank.

Additional prior art patented teachings for more dissimilar devices intended to serve the same overall function are disclosed in the following U.S. patents:

U.S. Pat. No. 1,907,826 to Kapp
U.S. Pat. No. 3,579,664 to Johnson

U.S. Pat. No. 4,551,866 to Hibbs
U.S. Pat. No. 5,058,216 to Trayer, et al.
U.S. Pat. No. 5,060,318 to Jaskiewicz
U.S. Pat. No. 5,222,260 to Piper
U.S. Pat. No. 5,307,524 to Veal
U.S. Pat. No. 5,369,814 to Denys
U.S. Pat. No. 5,410,766 to Schumacher
U.S. Pat. No. 5,570,478 to Armstrong
U.S. Pat. No. 5,774,904 to McWilliams
U.S. Pat. No. 5,781,938 to Anderson
U.S. Pat. No. 5,867,843 to Robello
U.S. Pat. No. 5,884,342 to Maake
U.S. Pat. No. 6,240,574 to Mayyak
U.S. Pat. No. 6,438,764 to Andersen

BRIEF SUMMARY OF THE INVENTION

This invention is directed to an apparatus for automatically lowering a raised toilet seat pivotally attached to a back of a bowl of a toilet. The apparatus includes a preferably U-shaped support member to be supported over a front wall of the water tank. An elongated arm is pivotally supported at an upper end thereof to an upper end of the support member. A float is to be positioned in the water tank and is moved vertically on the support member when the tank is flushed. A movable member is positioned in contact between the support member and the arm and is attached to a flexible line which extends along the support member to the float. The movable member is arranged to pivotally move the arm outwardly when the toilet is flushed, pushing the cover and toilet seat together away from the tank a distance sufficient for the cover and toilet seat to then pivotally fall into a closed position atop the bowl.

It is therefore an object of this invention to provide an apparatus for automatically lowering the toilet seat and cover of a toilet after each flush.

It is yet another object of this invention to provide an easily installable and economically manufacturer toilet seat lowering apparatus.

Yet another object of this invention is to provide a toilet seat lowering apparatus which automatically pushes the toilet seat cover a distance sufficient to allow gravity to carry the toilet seat downwardly to its closed position.

Still another object of this invention is to provide an apparatus for automatically lowering the toilet seat cover which has enhanced frictionless features for smooth, reliable operation.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
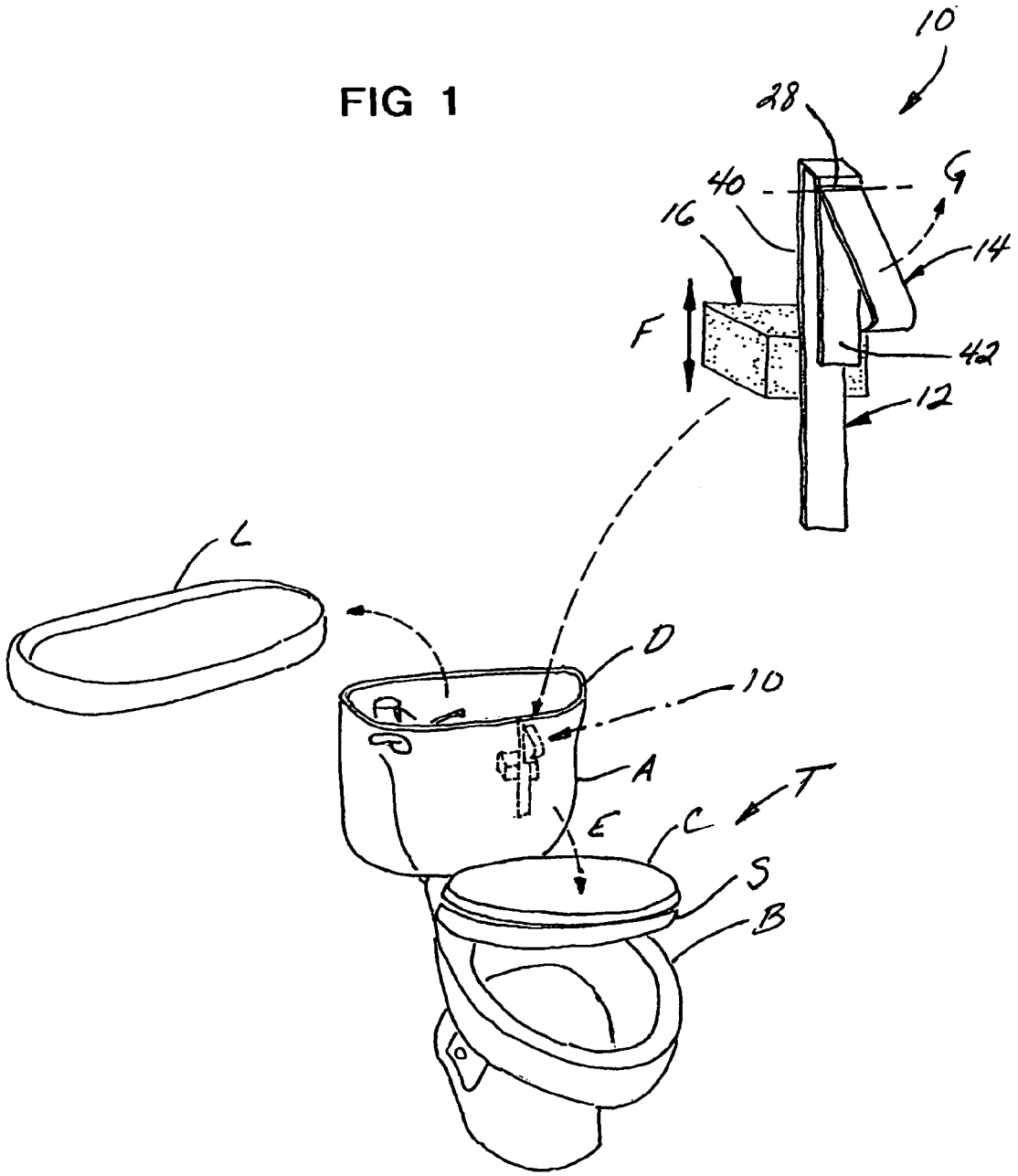
FIG. 1 is a simplified pictorial view of the invention being installed in phantom onto a tank of a toilet.

Referring now to the drawings, and firstly to FIG. 1, the invention in its preferred embodiment is shown schematically generally at numeral 10 and in phantom attached to the upper front wall D of a tank A of a toilet T. The invention 10 generally includes an inverted U-shaped support member assembly 12, a float assembly 16 and an arm assembly 14. With the lid L removed as shown, the apparatus 10 is slidably engageable over the front wall D of the tank A by slidable downward engagement of a U-shaped support member 12 thereover.

Referring additionally to FIGS. 2 to 6 and 11, the float assembly 16, which is slidably held for vertical translation in the direction of arrow F, includes an enlarged buoyant member 18 formed of STYRAFOAM® or other suitable buoyant material having a relative density less than that of water. Additionally, a weight 20 is provided so that the overall weight of the float assembly 16 is sufficient to function as described herebelow.

Figure 4:
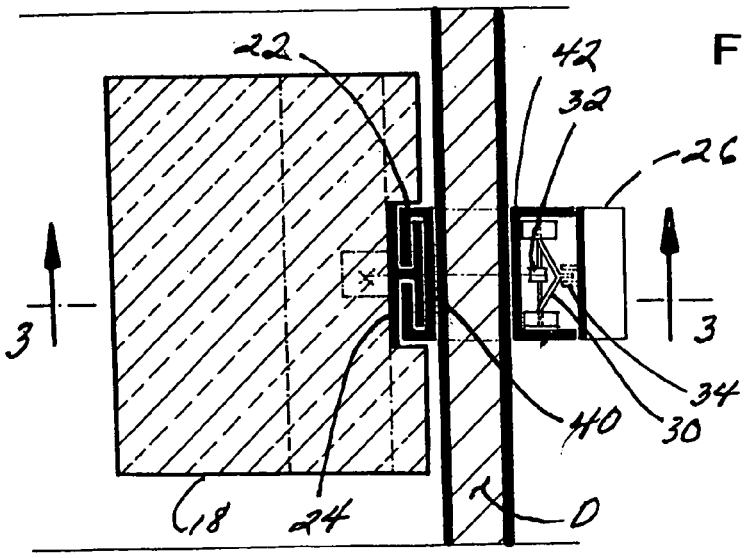
FIG. 4 is a section view in the direction of arrows 4—4 in FIG. 3.
Figure 5:
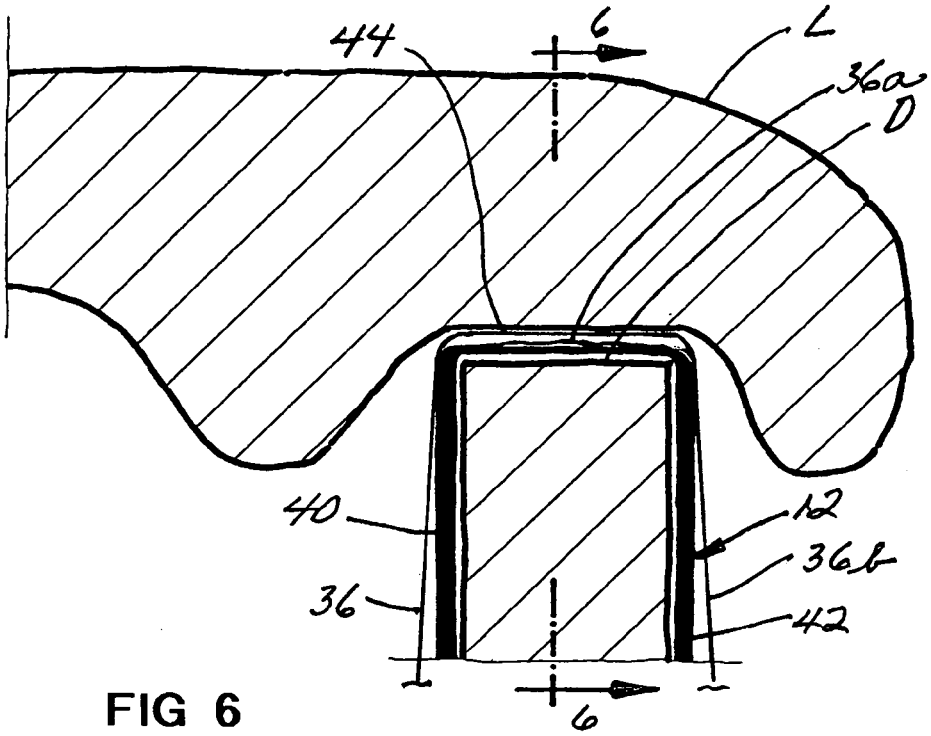
FIG. 5 is an enlarged view of the upper portion of FIG. 3 as a section view in the direction of arrows 5—5 in FIG. 6.

To accomplish smooth slidable translation of the float assembly 16 up and down in the direction of arrow F responsive to toilet flushing, the support member assembly 12, formed preferably of molded plastic material, includes an inner leg 40 which defines a C-shaped channel as best seen in FIG. 4. A mating T-shaped channel 22 attached to mounting plate 24 connects to the buoyant member 18.

Figure 11:
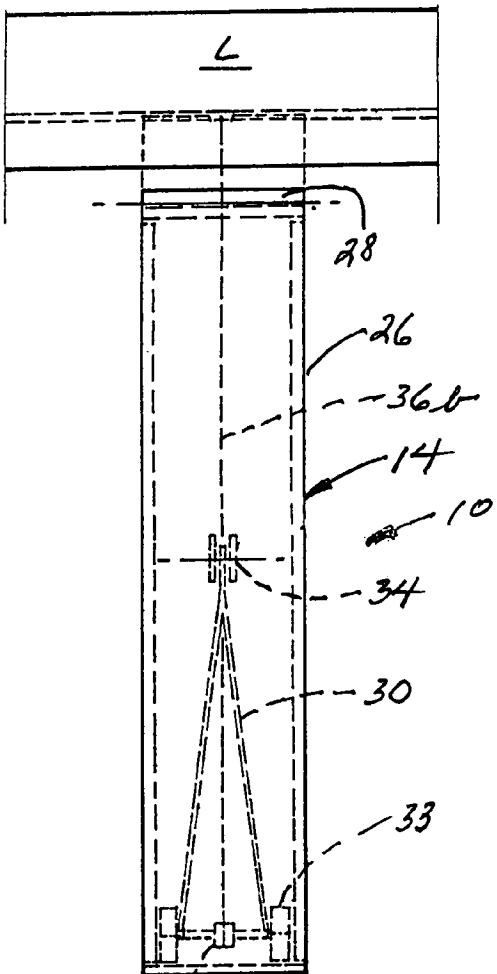
FIG. 11 is a front elevation view of the invention shown in FIG. 2.

An elongated arm 26, also preferably plastic molded, is pivotally connected at 28 to the outer upright elongated leg 42 about an axis pivotal transverse to the support member assembly 14 as best seen in FIG. 11. The arm 26 is freely pivotable in the direction of arrow G about the pivotal connection 28. As best seen in phantom in FIG. 2, when the arm 26 is moved to its full extent outwardly in the direction of arrow G, the cover C, which is pivotally movable in the direction of E about transverse axis J, is responsively moved pivotally to the position shown in phantom whereupon gravity will then automatically further pivot the cover C downwardly into the closed position atop the seat S and toilet bowl B of FIG. 1.

Figure 6:
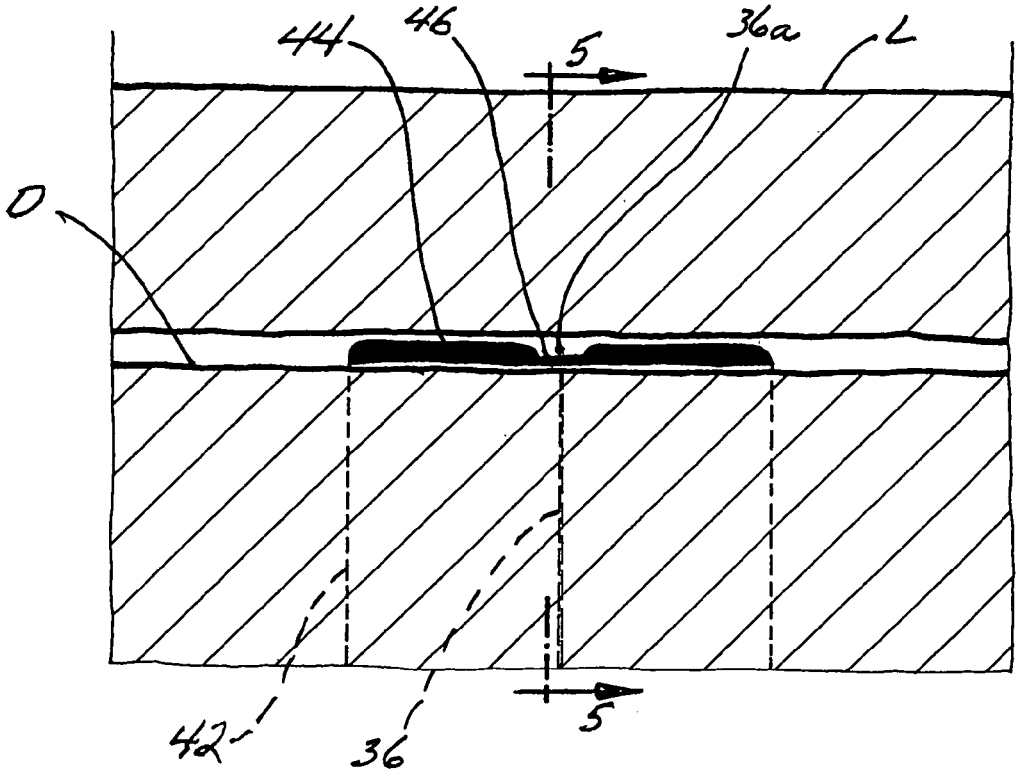
FIG. 6 is a section view in the direction of arrows 6—6 in FIG. 5.

To translate the downward movement in the direction of arrow F of the float 16 responsive to toilet flushing into pivotal movement in the direction of arrow G by the elongated arm 14, a flexible line 36, such as a nylon line, is connected at one end to the pivotal joint 28, then extends downwardly to wrap around a guide wheel 32 which is connected to the distal end of an elongated movable member in the form of a strut 30, the opposite end of which is pivotally connected at 34 to an inner mid point of arm 26. Thereafter, the flexible line extends upwardly to continue over the top or apex 36*a* of the support member 12. As best seen in FIG. 6, the apex 36*a* includes a central groove 46 over which the flexible line 36 is fed which substantially prevents any lateral movement of the flexible line during flushing and refilling of the toilet tank A.

The flexible line 36 continues along a portion of the inner leg 40 to be attached at 38 to the weight 20 of the float assembly 16. As the float assembly 16 moves downwardly in the direction of arrow F, the flexible line 36 thus causes the strut 30 to be moved pivotally from the position shown in solid in FIGS. 2 and 3 to the position shown in phantom. To reduce drag or friction, note that the free lower distal end of the strut 30 includes rollable wheels 33 which rollably engage against the outer surface of leg 42 of support member 12 responsive to the tensioning force applied by the flexible line 36 as the float 16 moves downwardly in the direction of arrow F.

Figure 2:
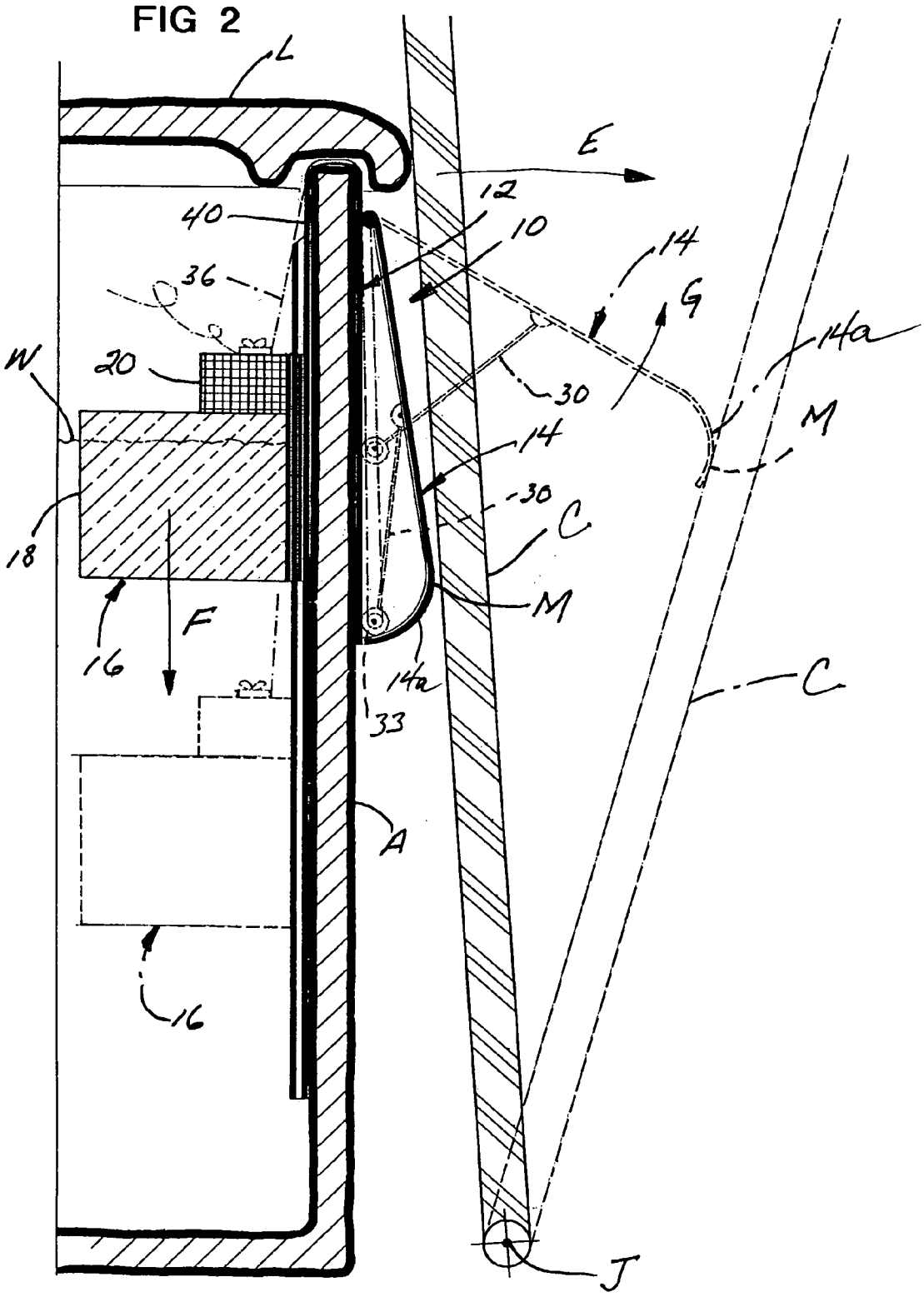
FIG. 2 is a side elevation section view of the invention of FIG. 1.
Figure 3:
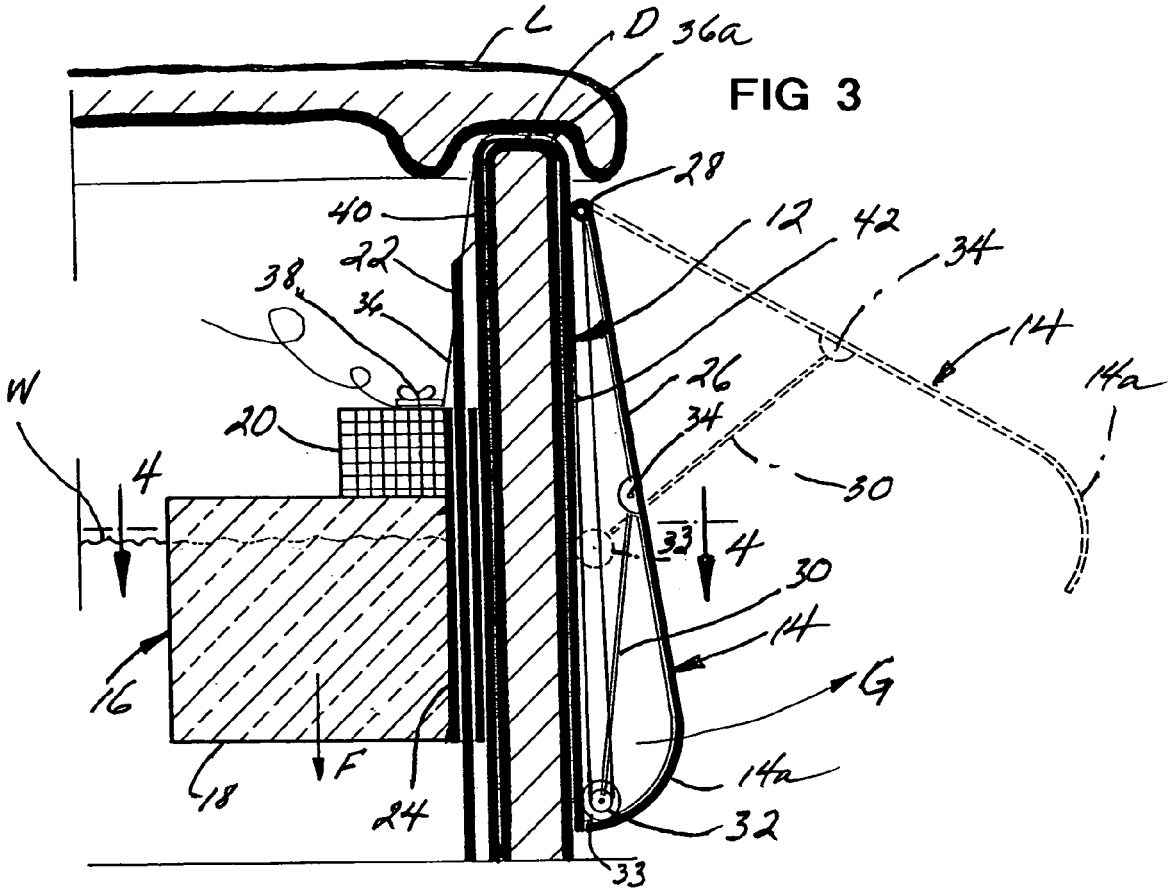
FIG. 3 is an enlarged view of a portion of FIG. 2 as a section view in the direction of arrows 3—3 in FIG. 4 showing the elongated arm movement in phantom.

As best seen in FIGS. 4 and 11, it is preferred that the movable strut 30 be formed in two segments having an elongated A-shape, the distal lower ends being attachable to the spaced apart rollers 33 strattling the smaller guide wheel 32. Note further that, to improve smooth operation and to reduce frictional losses, the lower distal end 14*a* of the arm assembly 14 is arcuately contoured so that, as best seen in FIG. 2, a smooth uniform contact at M against the mating surface of the cover C is effected during closing movement of the cover C as the arm assembly 14 is pivoted outwardly in the direction of arrow G into the position shown in phantom.

Figure 7:
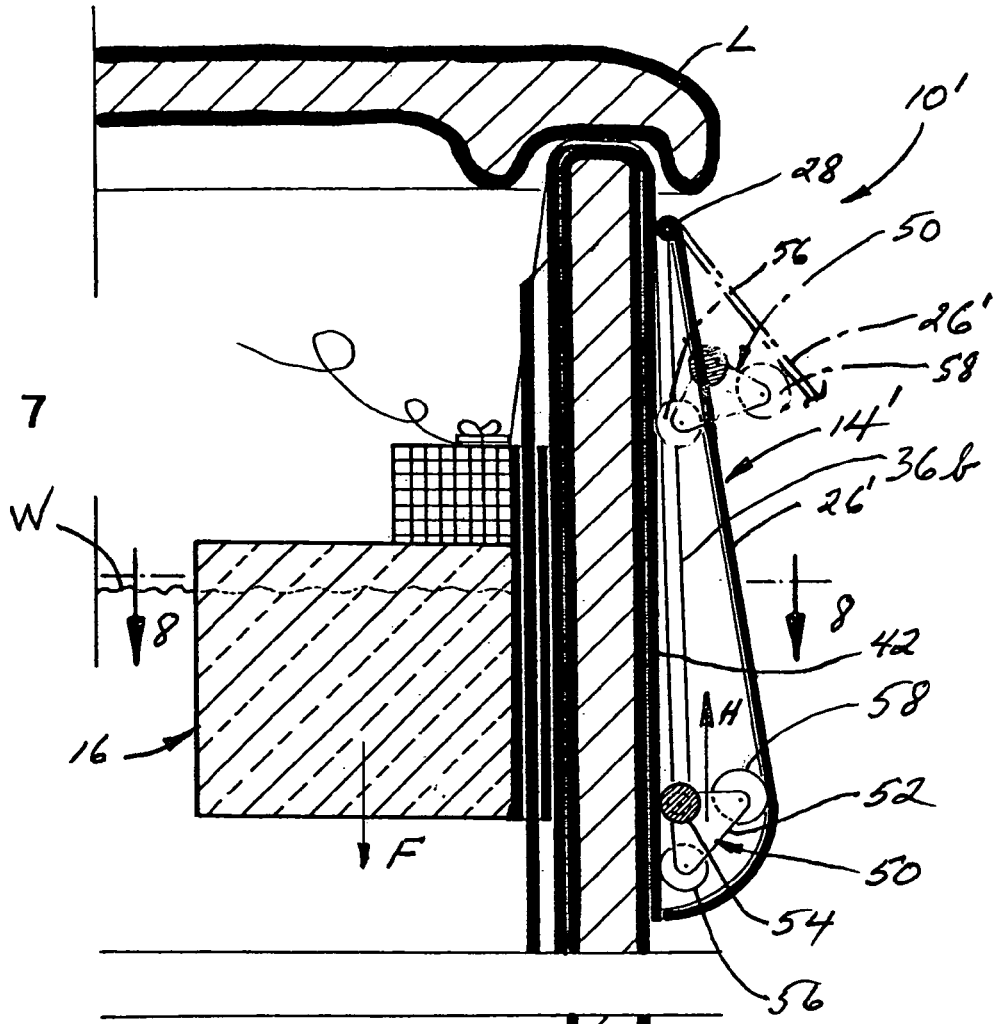
FIG. 7 is a side elevation section view in the direction of arrows 7—7 in FIG. 8 showing an alternate embodiment of the invention.
Figure 8:
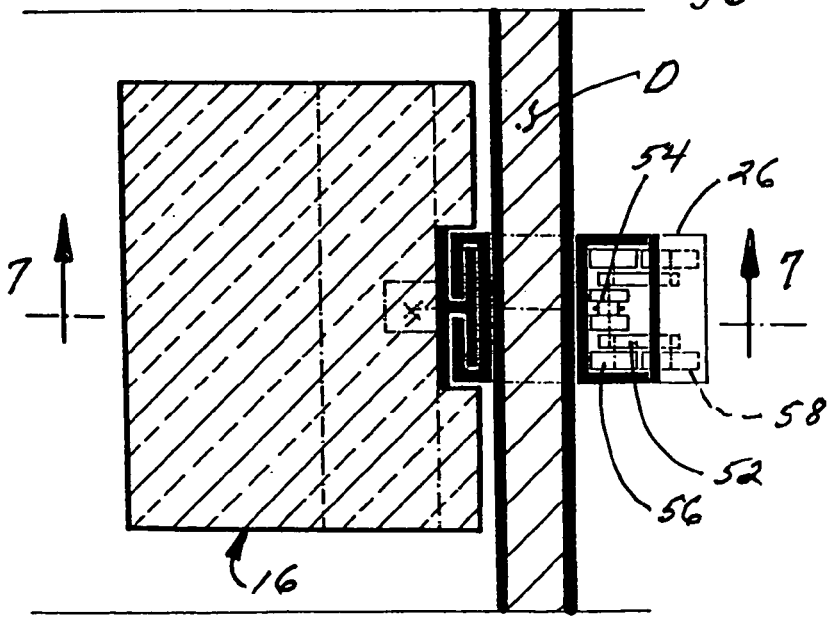
FIG. 8 is a section view in the direction of arrows 8—8 in FIG. 7.
Figure 12:
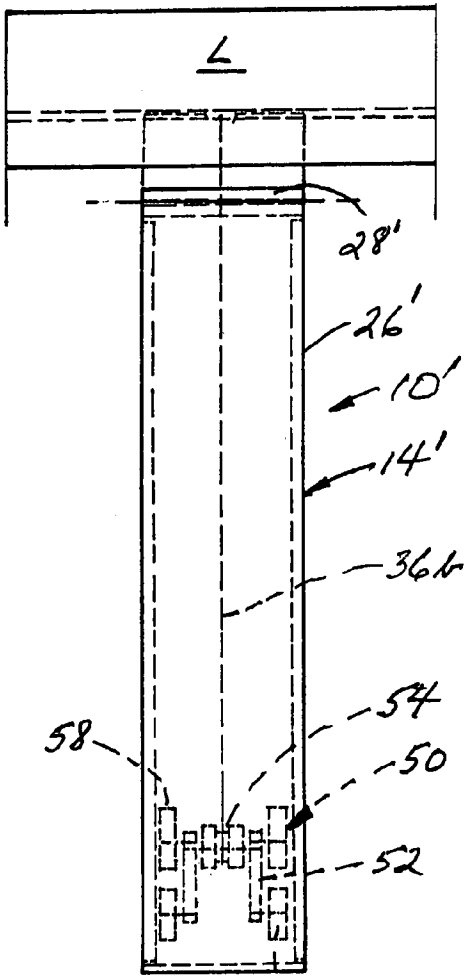
FIG. 12 is a front elevation view of the invention shown in FIG. 7.

Referring now to FIGS. 7, 8 and 12, an alternate embodiment of the invention is there shown generally at numeral 10'. All of the corresponding numbered components there shown are identical to those previously described. However, in this embodiment 10', the arm 26' of arm assembly 14 is modified by the deletion of the pivotal connection at 36 no longer required. To translate the downward movement of the float assembly 16 in the direction of arrow F into pivotal movement of the arm assembly 14' outwardly to close the cover C as previously described, a separate movable wheeled member or carriage 50 is provided having spaced flat plates 52 supporting spaced freely rotatable wheel pairs 56 and 58 and central wheel guides 54 for receiving the flexible line 36*b* as previously described.

By this arrangement, the downward movement of the float assembly 16 in the direction of arrow F causes the wheeled carriage member 50 to move upwardly in the direction of arrow H about the central grooved wheel 54 into the position shown in phantom. While doing so, wheels 56 rollably engage against leg 42 while wheels 58 rollably engage against the inner surface of arm 26'. This embodiment 10' thus provides virtually frictionless rolling movement of the movable wheeled carriage member 50 upwardly and then back downwardly as the water in the tank is restored to its at-rest filled level.

Figure 9:
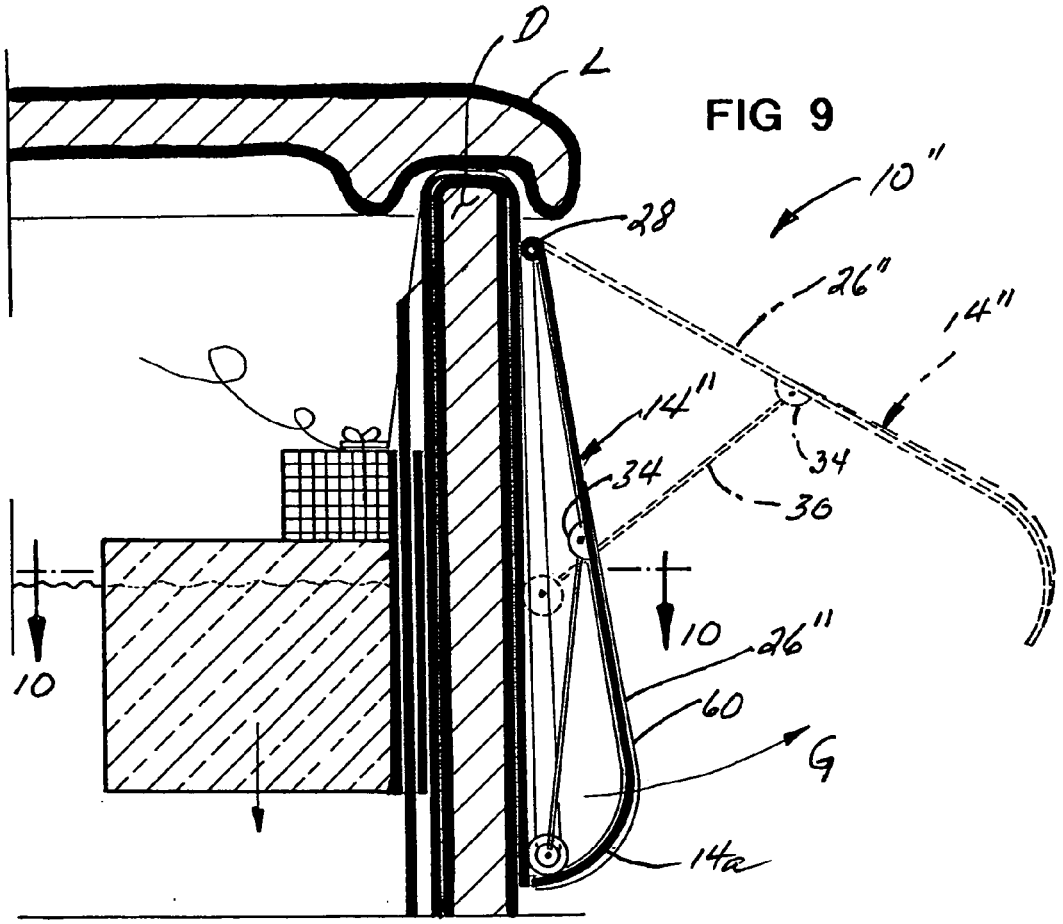
FIG. 9 is a cross section view in the direction of arrows 9—9 in FIG. 10 showin yet another embodiment.
Figure 10:
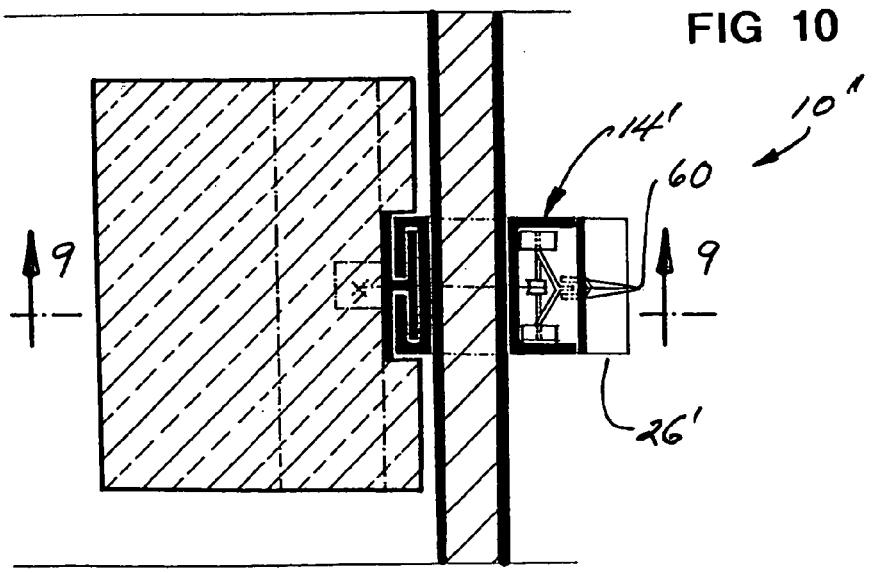
FIG. 10 is a section view in the direction of arrows 10—10 in FIG. 9.
Figure 13:
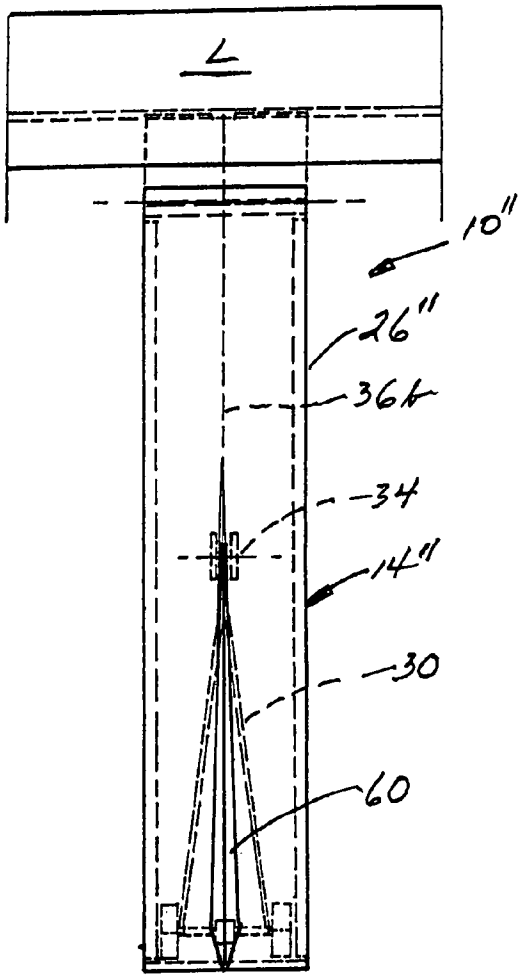
FIG. 13 is a front elevation view of FIG. 9.

Referring now to FIGS. 9, 10 and 13, another alternate embodiment of the invention is there shown generally at numeral 10" and is identically configured with respect to the embodiment 10 of FIGS. 1 to 6. However, in this embodiment 10", the movable arm 26' of the movable arm assembly 14' includes an additional sharp outwardly extending rib 60 extending longitudinally downwardly from the pivotal connection at 34 to the distal edge of the arcuate portion 14*a*. By providing this outwardly extending edge or bead 60, the friction caused by pressure against the cover C during closure thereof is further reduced.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An apparatus for automatically lowering together a raised toilet seat and cover pivotally attached to a back of a bowl of a toilet, the toilet also including a water tank and a lid, said apparatus, comprising:

a support member to be supported over a front upper open perimeter of the water tank;

an elongated arm pivotally supported at an upper end thereof to said support member about a pivot axis oriented substantially transversely to said support member, said axis positioned in proximity to an upper end of said support member;

a float to be positioned in the tank and vertically movable on said support member responsive to corresponding changes in water level in the tank when the tank is flushed;

a movable member positioned in contact between said support member and said arm;

a flexible line extending between said float and said movable member along said support member, said movable member arranged to pivotally move said arm outwardly responsive to downward movement of said float when the toilet is flushed;

a lower distal end of said arm contacting and pushing the cover and toilet seat together away from the tank a distance sufficient for the cover and toilet seat to pivotally fall by gravity onto the bowl.

2. An apparatus as set forth in claim 1, wherein:

a distal lower end of said arm is transversely arcuately shaped for smooth engagement against the cover.

3. An apparatus as set forth in claim 2, wherein:

said distal lower end includes a narrow rib extending lengthwise of said arm for reduced frictional engagement against the cover during closure thereof.

4. An apparatus for automatically lowering together a raised toilet seat and cover pivotally attached to a back of a bowl of a toilet, the toilet also including a water tank and a lid, said apparatus, comprising:

a U-shaped support member to be supported over a front upper open perimeter of the water tank;

an elongated arm pivotally supported at an upper end thereof to said support member about a pivot axis oriented substantially transversely to said support member, said axis positioned in proximity to an upper end of said support member;

a float to be positioned in the tank and held on one leg of said support member for substantially only sliding vertical movement responsive to corresponding changes in water level in the tank when the tank is flushed;

an elongated strut member pivotally connected at one end thereof to said arm and freely movable at a second end of said strut member along and against a second leg of said support member;

a flexible line extending along said support member between said float and said second end of said strut member to pivotally move said arm outwardly responsive to downward movement of said float when the toilet is flushed;

a lower distal end of said arm contacting and pushing the cover and toilet seat together away from the tank a distance sufficient for the cover and toilet seat to pivotally fall by gravity onto the bowl.

5. An apparatus as set forth in claim 4, wherein:

a distal lower end of said arm is transversely arcuately shaped for smooth engagement against the cover.

6. An apparatus as set forth in claim 5, wherein:

said distal lower end includes a narrow rib extending lengthwise of said arm for reduced frictional engagement against the cover during closure thereof.

7. An apparatus for automatically lowering together a raised toilet seat and cover pivotally attached to a back of a bowl of a toilet, the toilet also including a water tank and a lid, said apparatus, comprising:

a U-shaped support member having downwardly extending inner and outer legs adapted to be supported in saddle-like fashion over a front wall of an upper open perimeter of the water tank;

an elongated arm pivotally supported at an upper end thereof to said support member about a pivot axis horizontally oriented substantially transversely to said support member, said axis positioned in proximity to an upper end of said support member;

a float to be positioned in the tank and being held on said inner leg for free sliding movement therealong responsive to corresponding changes in water level in the tank when the tank is flushed;

a separate movable wheeled member positioned in rolling substantially frictionless contact between said outer leg and an inward facing surface of said arm;

a flexible line extending over an upper most portion of said support member and between said float and said wheeled member, said wheeled member arranged to pivotally move said arm outwardly responsive to downward movement of said float when the toilet is flushed;

a lower distal end of said arm contacting and pushing the cover and toilet seat together away from the tank a distance sufficient for the cover and toilet seat to pivotally fall by gravity onto the bowl.

8. An apparatus as set forth in claim 7, wherein:

a distal lower end of said arm is transversely arcuately shaped for smooth engagement against the cover.

9. An apparatus as set forth in claim 8, wherein:

said distal lower end includes a narrow rib extending lengthwise of said arm for reduced frictional engagement against the cover during closure thereof.

* * * * *